US006508087B2

(12) United States Patent
Lemley et al.

(10) Patent No.: US 6,508,087 B2
(45) Date of Patent: Jan. 21, 2003

(54) LOCKING SYSTEM FOR CONTAINERS

(75) Inventors: Russ Lemley, Chandler, AZ (US); Aric Clawson, Phoenix, AZ (US)

(73) Assignee: Mobile Mini, Inc., Tempe, AZ (US)

( * ) Notice: Subject to any disclaimer, the term of this patent is extended or adjusted under 35 U.S.C. 154(b) by 65 days.

(21) Appl. No.: 09/867,182

(22) Filed: May 29, 2001

(65) Prior Publication Data

US 2002/0178767 A1 Dec. 5, 2002

(51) Int. Cl.[7] ..... E05B 67/38

(52) U.S. Cl. ..... 70/56; 70/212; 292/3; 292/7; 292/36

(58) Field of Search ..... 70/2, 54–56, 212, 70/120, 83, 103, 113, 114, 118, 128, 130, 451; 292/3, 7, 36, 37, 40, 42, 212, 143, 145, 148, 139, 156, 218, DIG. 32, DIG. 68

(56) References Cited

U.S. PATENT DOCUMENTS

| | | | | | |
|---|---|---|---|---|---|
| 966,195 | A | * | 8/1910 | Golden | 292/36 |
| 1,046,438 | A | * | 12/1912 | Caldwell | 70/120 X |
| 1,643,538 | A | * | 9/1927 | Bell | 292/37 |
| 2,069,883 | A | * | 2/1937 | Hennicke | 70/74 |
| 2,169,692 | A | * | 8/1939 | Hansen | 292/5 |
| 2,189,019 | A | * | 2/1940 | Rowe | 70/114 X |
| 2,452,521 | A | * | 10/1948 | Johnson et al. | 292/7 |
| 3,187,526 | A | * | 6/1965 | Moler | 70/100 |
| 4,195,502 | A | * | 4/1980 | Best et al. | 70/224 |
| 4,468,943 | A | * | 9/1984 | Beattie et al. | 292/36 X |
| 4,470,277 | A | * | 9/1984 | Uyeda | 70/118 |
| 4,639,021 | A | * | 1/1987 | Hope | 292/7 |
| 4,643,005 | A | * | 2/1987 | Logas | 70/95 |
| 4,655,059 | A | * | 4/1987 | Best et al. | 70/224 |
| 4,742,701 | A | * | 5/1988 | Scavetto | 70/54 X |
| 5,029,909 | A | * | 7/1991 | Bunger | 292/40 |
| 5,071,176 | A | * | 12/1991 | Smith | 292/7 |
| 5,261,258 | A | | 11/1993 | Bunger | |
| 5,350,207 | A | * | 9/1994 | Sanders | 292/42 X |
| 5,509,700 | A | | 4/1996 | Kennedy, Jr. | |
| 5,660,420 | A | * | 8/1997 | Smith et al. | 292/3 |
| 5,778,708 | A | * | 7/1998 | Crosby et al. | 70/118 |
| 5,911,763 | A | * | 6/1999 | Quesada | 292/36 X |
| 5,938,248 | A | * | 8/1999 | Vickers et al. | 292/36 |
| 6,065,314 | A | * | 5/2000 | Nicholson | 70/212 |

* cited by examiner

*Primary Examiner*—Suzanne Dino Barrett
(74) *Attorney, Agent, or Firm*—Frank J. McGue

(57) ABSTRACT

A locking system is disclosed for use with a cargo container. The locking system comprises a housing which is adapted to be mounted to a door of the cargo storing container. Three rods extend from the housing with the rods having a locked position extending beyond the periphery of the door and an unlocked position not extending beyond the periphery of the door. A handle extends from the housing. The handle rotatably engages a cam plate contained within the housing. The cam plate is operatively engaged with the three rods whereby rotation of the handle rotates the cam plate which moves the rods from one position to the other. A locking tab extends forwardly from the cam plate into a recess in the housing. The locking tab is engaged by a circular lock while the recess prevents movement of the engaged circular lock.

24 Claims, 9 Drawing Sheets

LOCKING SYSTEM FOR CONTAINERS

TECHNICAL FIELD

This invention relates to an improved locking system for containers, in particular, for storage containers.

BACKGROUND OF THE INVENTION

Although the prior art shows locking systems for containers, none are believed to illustrate the type of device disclosed and claimed.

Storage containers referred to in the present specification are generally large, walk in boxes similar in size to semi-trailer trucks. The containers can be stacked and shipped by rail and by ship easily. In addition, such containers are used as storage devices by end users.

With any such container, maintaining security for the contents is a prime concern. Because such containers are often left unattended, they become targets for thieves and other criminals. Thus, the manufacturers and users of such containers continue to seek and develop better security techniques while the criminal element continues to develop methods for attacking and circumventing those security measures.

Various types of locking systems have been described in the prior art.

U.S. Pat. No. 5,261,258 entitled "Padlock Protector" which issued on Nov. 16, 1993 owned by assignee of the present invention discloses a security device which consists of an exterior mounted housing for a latch bar which defines a recess. The recess provides access to an aperture in the bar by a circular shackle of a disk shaped padlock. This device operates in much the same fashion as the present invention. However, it is also believed to be less effective because of its exterior mounting and structure allow some access to the locking mechanism and the shaft by drills and hammer devices.

U.S. Pat. No. 5,509,700 entitled "Latch and Lock for Trailer Doors" which issued on Apr. 23, 1996 to Kennedy, Jr., and owned by assignee of the present invention, discloses a concealed latch with an arm attached to a pivot operatively connected to a pair of locking bars.

None of the known prior art disclose the device set forth herein.

SUMMARY OF THE INVENTION

It is an object of this invention to provide an improved locking system for storage containers which provides additional security therefore.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
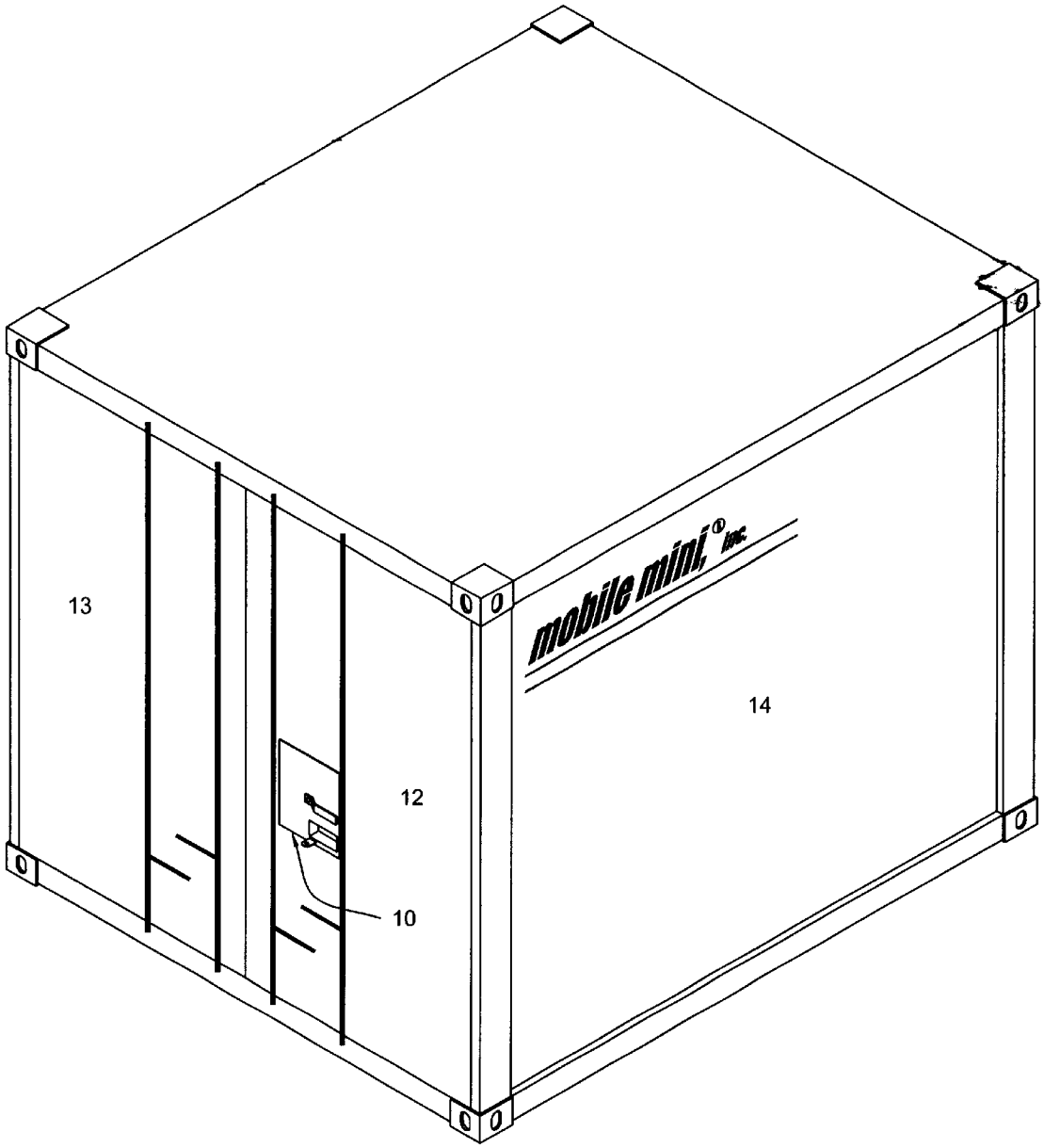
FIG. 1 is a perspective front and side view of a storage container embodying the present invention.
Figure 2:
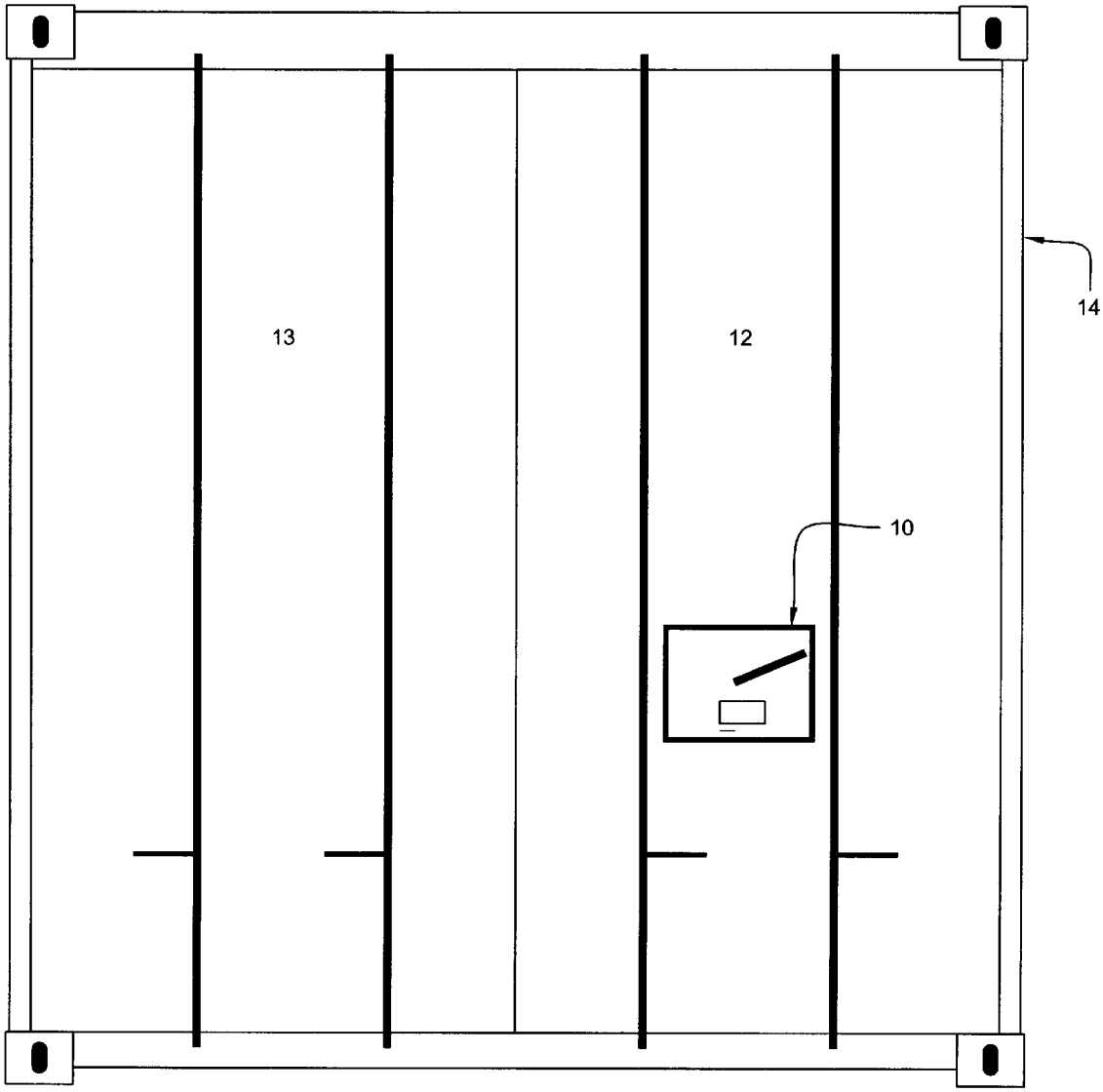
FIG. 2 is a front of the embodiment of FIG. 1.

Referring more particularly to the drawings by characters of reference, FIGS. 1–8 disclose one embodiment of an improved locking system 10 mounted to one door 12 of a cargo storing container 14 or other door assembly and the floor thereof. Door 12 and its companion door 13 overlap and open outwardly with door 13 being closed first and door 12 being closed thereafter. The operation of such doors 12 and 13 are well known to those of ordinary skill in the art and will not be further discussed herein. Note that some doors 12 and 13 do not overlap. In that event, tabs must be added to door 13 to create an appropriate overlap for locking system 10 to function properly.

Figure 3:
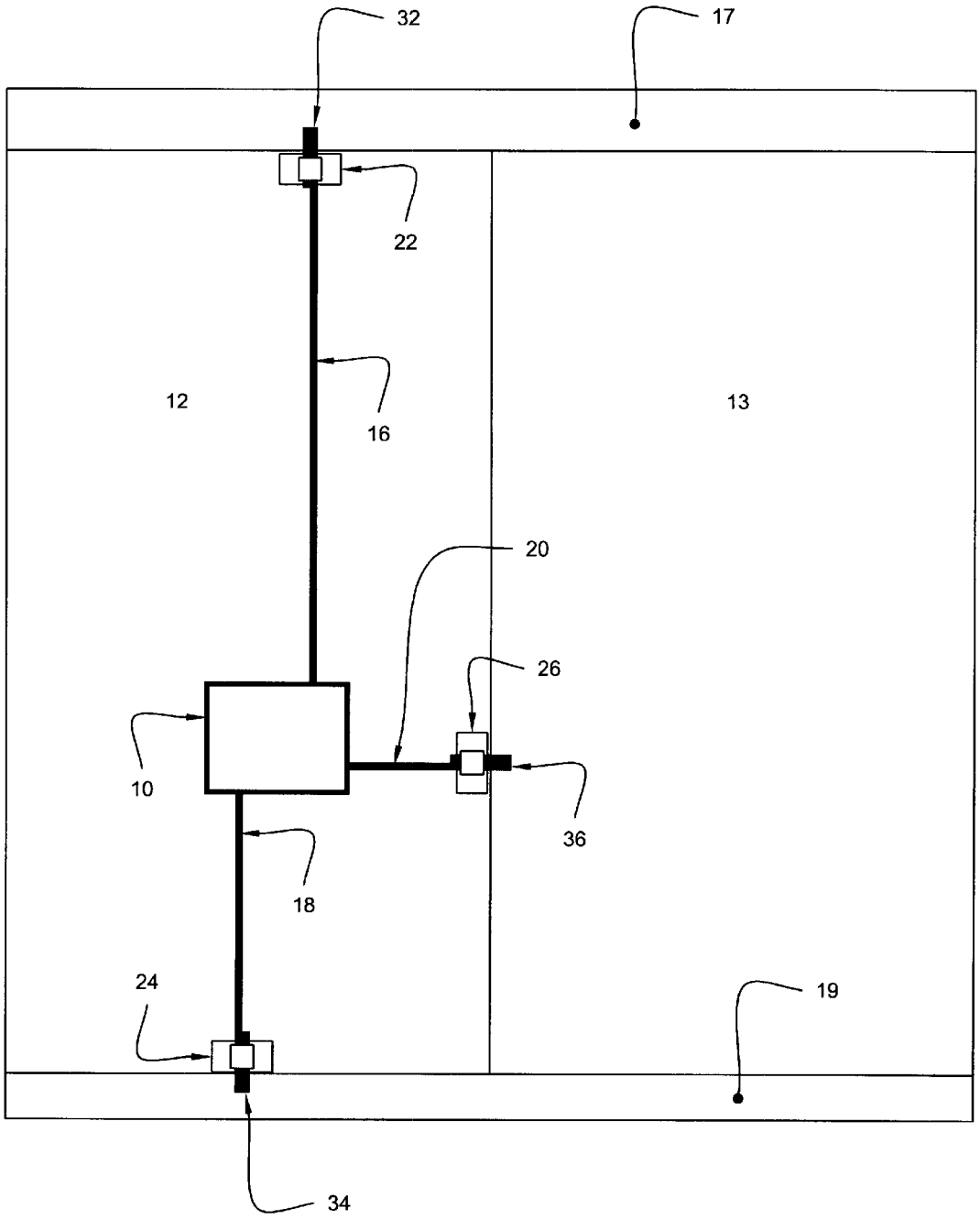
FIG. 3 is a rear view of the embodiment of FIG. 1 in a locked position.
Figure 4:
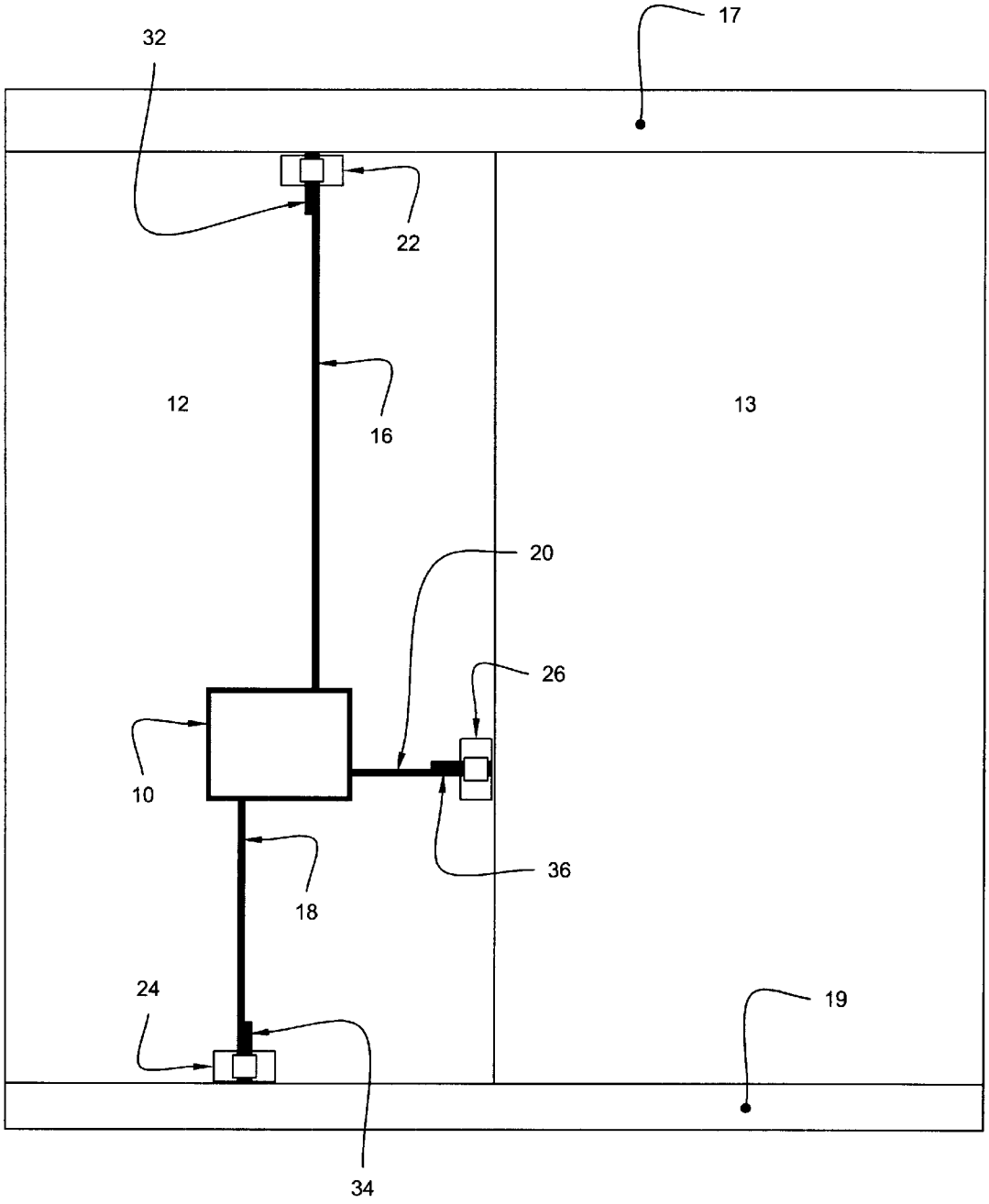
FIG. 4 is a rear view of the embodiment of FIG. 1 in an unlocked position.

As best seen in FIGS. 3 and 4, locking system 10 operatively engages a top rod 16 extending upwardly therefrom, a bottom rod 18 extending downwardly therefrom and a horizontal rod 20 extending laterally therefrom towards door 13. Rods 16, 18 and 20 are mounted on the interior side of door 12. Rods 16, 18 and 20 have a locked position illustrated in FIG. 3 wherein the rods extend just beyond the periphery of door 12 to engage a ceiling 17, a floor 19 and door 13, respectively, and an unlocked position illustrated in FIG. 4 wherein the rods do not extend beyond the periphery of door 12. Locking system 10 slides rods 16, 18 and 20 between the two positions as desired. To open system 10, all three rods 16, 18 and 20 must be disengaged.

To align rods 16, 18 and 20, a top rod guide 22, a bottom rod guide 24 and a horizontal rod guide 26 are provided mounted on door 12 proximate to the periphery thereof. Rods 16 and 18 preferably engage a ceiling lock rod guide 22 and a floor lock rod guide 24. Rod 20 engages a door lock rod guide 26 on door 12 as shown.

Preferably, each rod 16, 18 and 20 include a sloped edge 32, 34 and 36, respectively, which facilitate alignment of each rod with a respective lock rod guide 22, 24, 26. In addition, preferably, rods 16, 18 and 20 are doubled in thickness at the distal end thereof. The extra thickness provides further security by strengthening an inherent access point where rods 16, 18 and 20 cross the periphery of door 12, i.e. where thieves often employ cutting tools. In the presently preferred embodiment, the rods are comprised of solid square steel bar and the doubling thereof is accomplished by welding two sections of the solid square steel bar together or casting them as a single piece.

Figure 5:
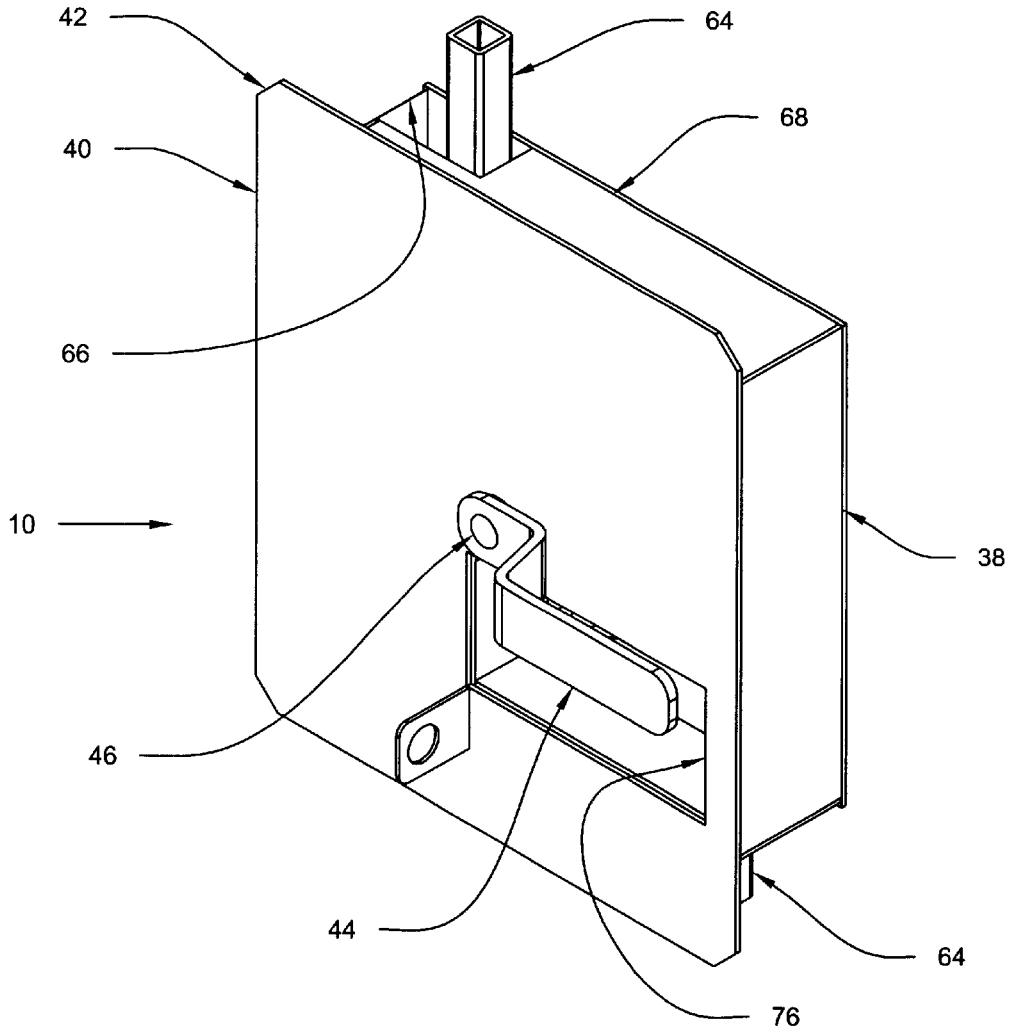
FIG. 5 is a close up perspective view of the present invention.

Turning now to FIGS. 5–8, the operation of locking system 10 is further detailed. As seen in FIG. 5, locking system 10 includes a box like housing 38 having a front panel 40. Front panel 40 includes an integral flange 42 extending outwardly from housing 38 which provides for mounting said housing on an opening 9 in door 12. Housing 38 and integral flange 42 are, preferably, made from a heavy gauge metal. For those storage containers 14 made of aluminum or a like material, locking system 10 is secured to door 12 by bolts extending through flange 42 which are secured to door 12 by nuts which are, most preferably, welded to the bolts for security.

A handle 44 rotatably engages an axle 46 extending through front panel 40. One feature of the present invention is to utilize a relatively short handle 44 to minimize the prying leverage available to a potential thief. In the most preferred embodiment, locking system 10 is positioned on door 12 whereby handle 44 is at a height convenient for users in a normal standing position.

Another ergonomic feature is that the direction of rotation of handle 44 to close door 12 is, preferably, a downward motion. Such a downward motion affords a user the ability to bear down on handle 44 with their entire body weight to assure engagement of locking rods 16, 18 and 20.

Further, in the presently preferred embodiment, the lock rods 16, 18 and 20 are designed and weighted to fall to the open position thereby preventing doors 12, 13 from accidentally locking a person inside, and further allowing operation of same with a minimum of force.

Lastly, handle 44 is attached to axle 46 using a weak weld whereby excessive force exerted upon handle 44 will cause separation of said handle from axle 46. In the event that axle 46 is damaged or broken, the integrity of locking system 10 is not compromised.

Figure 6:
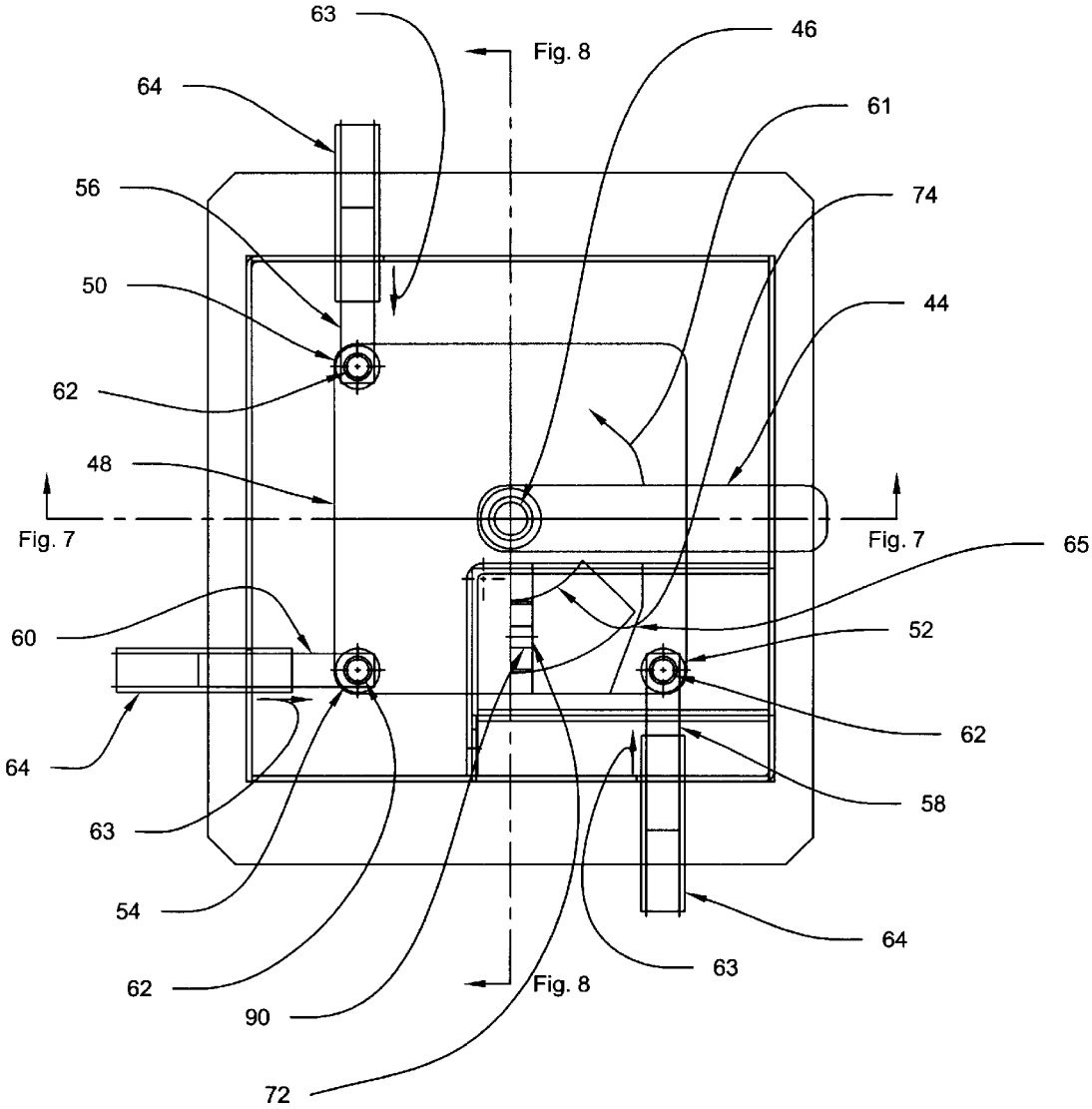
FIG. 6 is cross sectional front view of the embodiment of FIG. 5.
Figure 7:
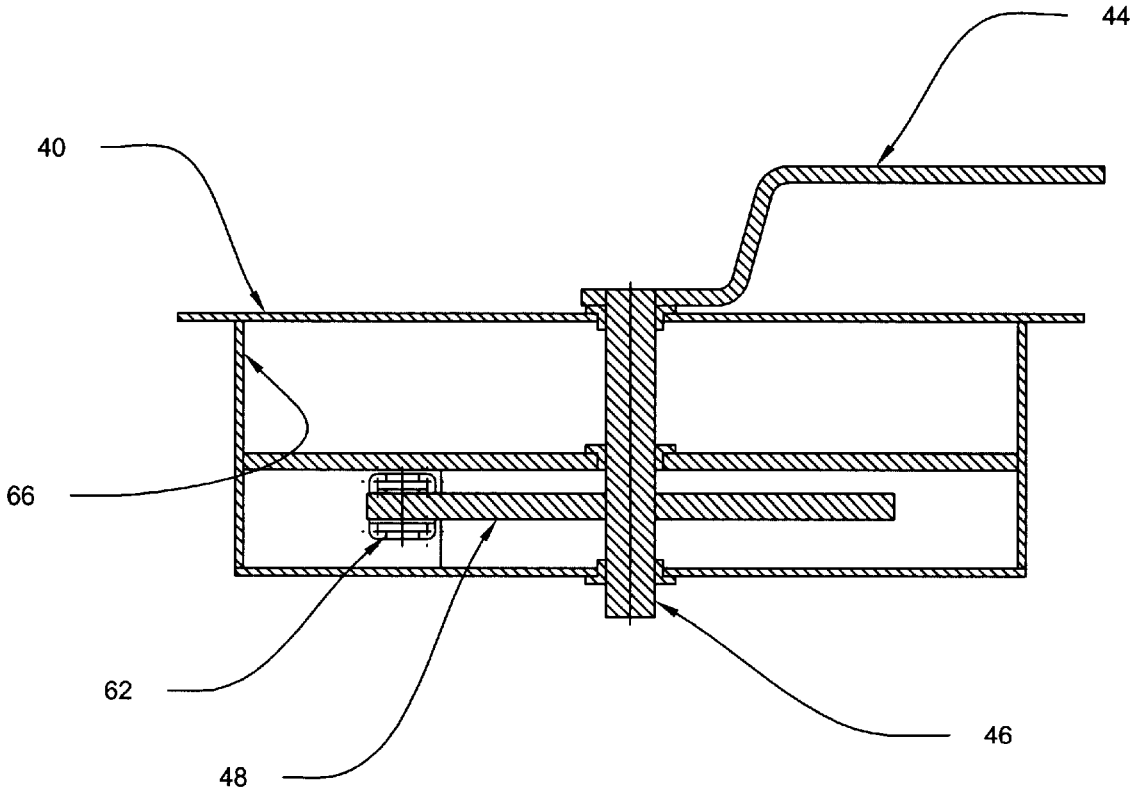
FIG. 7 is a cross sectional view taken along line 7—7 in FIG. 6.
Figure 8:
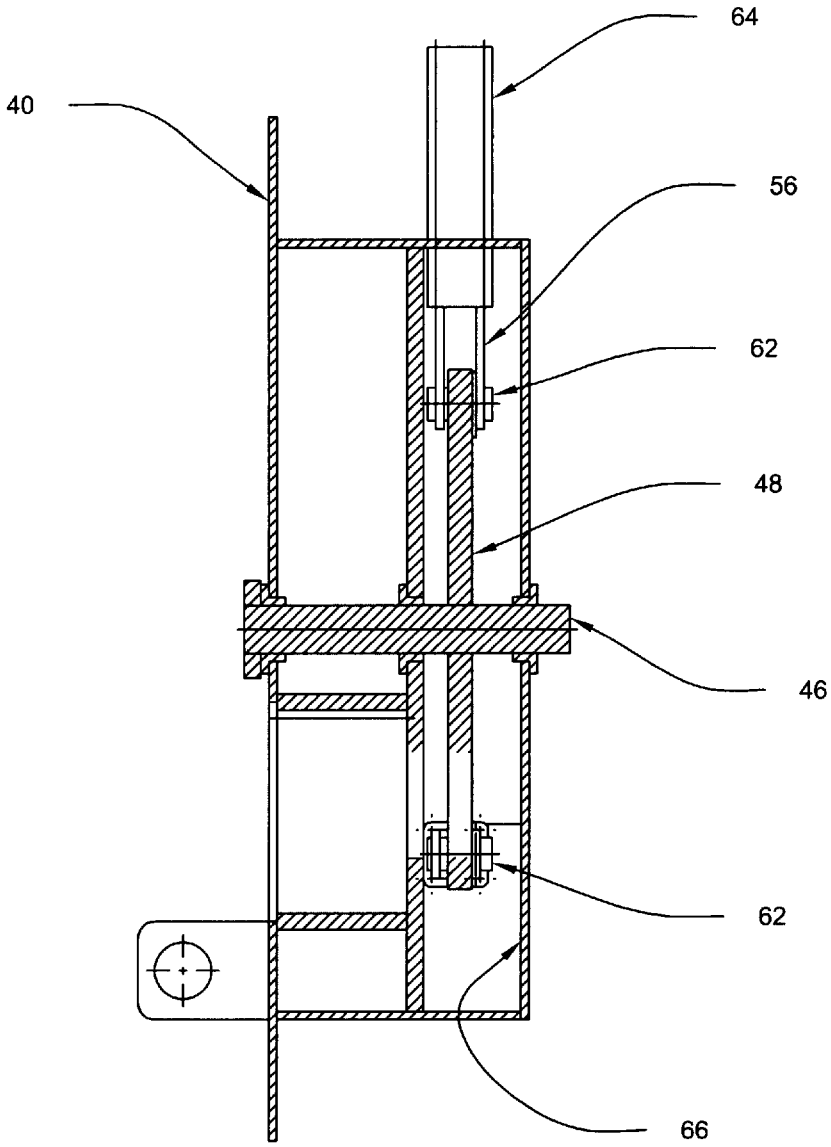
FIG. 8 is a cross sectional view taken along line 8—8 in FIG. 6.
Figure 9:
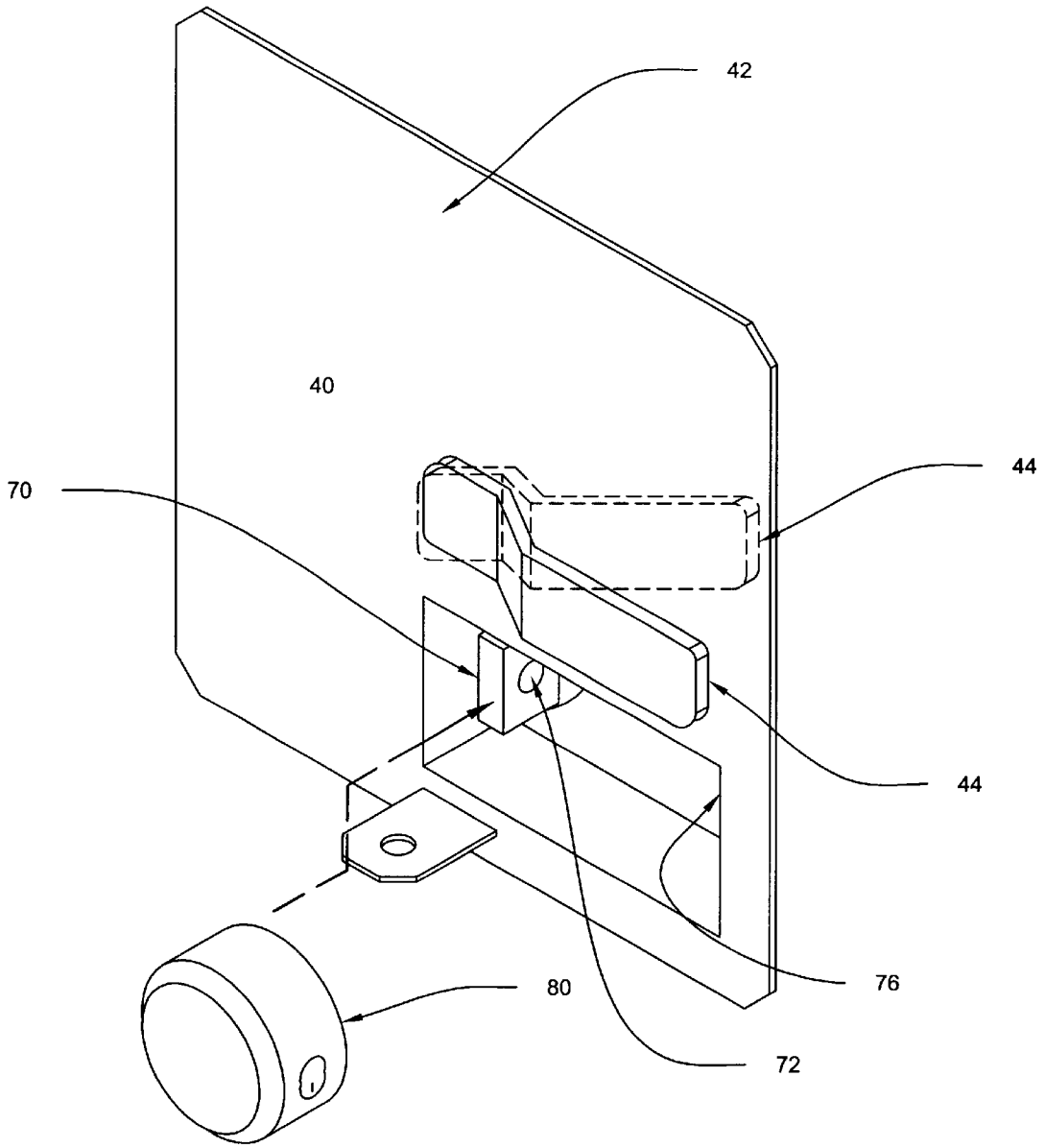
FIG. 9 is a close up perspective view of the present invention showing use of a circular lock therewith.

As best seen in FIG. 6, axle 46 operatively engages a cam plate 48 mounted within housing 38 which extends laterally therefrom. In the illustrated embodiment, cam plate 48 is square though those skilled in the art will recognize that the particular shape is not important.

At three corners 50, 52 and 54 of cam plate 48, a top shaft 56, a bottom shaft 58 and a side shaft 60, respectively, are mounted, preferably by bushings 62. Each shaft 56, 58 and 60 is mounted to a sleeve 64. Rods 16, 18 and 20 are slidably received within sleeves 64 corresponding to shafts 56, 58 and 60, respectively. The use of sleeves 64 permits the user to adjust the length of the rod/sleeve combination to compensate for dimensional variations in storage containers.

Further, cam plate 48 is includes anti-torque spacers 65 with maintain cam plate 48 in parallel alignment to housing 38, even if excessive force is applied to cam plate 48 via axle 46 and handle 44. Anti-torque spacers 65 also restrict the entry of outside elements into housing 38.

As best seen in FIG. 5, sleeves 64 extend through openings 66 in a sidewall 68 of housing 38. In the presently preferred embodiment, sleeves 64 and shafts 56, 58 and 60 are all comprised of square tubing or steel bar and are joined via welding to each other and to rods 16, 18 and 20. Those skilled in the art will recognize the suitability of other materials for the use described herein.

In FIG. 6, locking system 10 is shown in the locked position. To unlock, a user rotates handle 44, and hence cam plate 48 via axle 46, counterclockwise as shown by arrow 61 wherein shafts 56, 58 and 60 are pulled inwardly into housing 38 as shown by arrows 63 thereby retracting rods 16, 18 and 20 via sleeves 64 to the unlocked position.

A further advantage to locking system 10 is that retraction of rods 16, 18 and 20 into housing 38 affords installation of locking system 10 onto doors 12, 13 through opening 9 which is cut into the front of door 12. Such a construction assists in installation since housing 38 is a one piece installation.

Extending forwardly from cam plate 48 is a single piece, thick locking tab 70 having a lock hole 72 extending therethrough. Tab 70 extends through an arcuate gap 74 into a recess 76 extending inwardly from front plate 40 to cam plate 48 parallel to front plate 40. Tab 70 passes through a slot in cam plate 48, and is welded to both the front and back of cam plate 48. The ends of arcuate gap 74 provide stops which limit the travel of tab 70, and hence cam plate 48, thereby providing the end points for the locked and unlocked positions.

A circular lock 80 engages lock hole 72. Recess 76 is adapted to engage circular lock 80 and thereby prevent movement of tab 70, and hence cam plate 48, when circular lock 80 is engaged with tab 70. Thus, the entire body of circular lock 80 and recess 76 act to prevent movement from the locked position to the unlocked position until circular lock 80 is removed. Thus, movement of cam plate 48 and rods 16, 18 and 20 are not solely dependent upon the structural integrity of tab 70. Recess 76 also provides weather protection for locking system 10.

Although only certain embodiments have been illustrated and described, it will be apparent to those skilled in the art that various changes and modifications may be made therein without departing from the spirit of the invention or from the scope of the appended claims.

What is claimed is:

1. A locking system for use with a storage container, the locking system being mounted into a door of the cargo storing container, the locking system comprising:

a housing mounted to and extending through a door, three rods extending from the housing, the rods having a locked position extending beyond the periphery of the door and an unlocked position not extending beyond the periphery of the door, a handle extending from the housing, the handle rotatably engaging a cam plate contained within the housing, the cam plate being operatively engaged with the three rods, the handle rotating the cam plate to move the rods from one of the locked position and the unlocked position to the other of the locked position and the unlocked position, a locking tab extending forwardly from the cam plate into a recess in the housing, the locking tab adapted to be engaged by a circular lock, the recess adapted to prevent movement of the circular lock and the locking tab when said circular lock is engaged by the locking tab whereby the integrity of the locking system is not dependent upon the integrity of the locking tab.

2. The locking system of claim 1 wherein the locking tab includes a circular lock hole extending therethrough, the hasp of the circular lock extending through the circular lock hole.

3. The locking system of claim 1 wherein the locking tab extends through an arcuate gap into the recess, the ends of the arcuate gap providing stops for the locking tab, the stops defining the unlocked position and the locked position.

4. The locking system of claim 1 wherein the housing is box like in shape with a front panel having a integral flange, the flange adapted to flush mount to the exterior of a door with the housing extending inwardly therefrom.

5. The locking system of claim 1 wherein the handle rotatably engages an axle extending through the housing, the axle engaging the cam plate.

6. The locking system of claim 5 wherein the handle is short, the handle being mounted to the axle by a weak weld whereby said handle separates from the axle if excessive force is exerted on the handle.

7. The locking system of claim 1 wherein the three rods are mounted to the cam plate at three corners thereof.

8. The locking system of claim 7 wherein the rods are mounted to corresponding sleeves extending through the housing, the corresponding sleeves being mounted to corresponding shafts, the corresponding shafts being mounted to the three corners by corresponding bushings.

9. The locking system of claim 8 wherein the sleeves, the rods and the shafts are comprised of square and solid tubing joined by welding.

10. The locking system of claim 7 wherein the three rods comprise a top rod extending upwardly from the housing, a bottom rod extending downwardly from the housing and a horizontal rod extending laterally from the housing.

11. The locking system of claim 10 further comprising sleeves interposed between the cam plate and each of the three rods, the sleeves slidably receiving each of the three rods whereby the combination of the rods and the sleeves being adjustable in length.

12. The locking system of claim 10 further comprising rod guides are mounted proximate to the periphery of the door, the rod guides adapted to align the rods.

13. The locking system of claim 10 further comprising three lock rod guides mounted beyond the periphery of a door, each of the rods engaging one of the three lock rod guides when in the locked position.

14. The locking system of claim 13 wherein each rod includes a sloped edge adapted to facilitate alignment of each rod with the corresponding lock rod guide.

15. The locking system of claim 13 wherein each rod is thicker at the distal end thereof.

16. The locking system of claim 13 wherein all three locking rods must be compromised to gain access to the container.

17. The locking system of claim 1 wherein each rod is biased to the unlocked position.

18. The locking system of claim 1 further comprising anti-torque spacers interposed between the cam plate and the housing to maintain the cam plate and the housing in a parallel relationship.

19. A locking system for use with a storage container, the locking system being mounted to a door of the storage container, the locking system comprising:

a housing mounted to and extending through a door, the housing being box like in shape with a front panel having an integral flange, the flange adapted to mount said housing on a door, three rods extending from the housing, the three rods comprising a top rod extending upwardly from the housing, a bottom rod extending downwardly from the housing and a horizontal rod extending laterally from the housing, the rods having a locked position extending beyond the periphery of the door and an unlocked position not extending beyond the periphery of the door, a short handle extending from the housing, the short handle rotatably engaging an axle, the short handle being mounted to the axle by a weak weld whereby said short handle separates from the axle if excessive force is exerted on the short handle, the axle rotatably engaging a cam plate contained within the housing, the cam plate being operatively engaged with corners of the three rods, the short handle rotating the cam plate to move the rods from one of the locked position and the unlocked position to the other of the locked position and the unlocked position, a locking tab extending forwardly from the cam plate through an arcuate gap into a recess in the housing, the ends of the arcuate gap providing stops for the locking tab, the stops defining the unlocked position and the locked position, the locking tab including a circular lock hole extending therethrough, the circular lock hole adapted to engage a hasp of a circular lock, the recess adapted to prevent movement of the circular lock and the locking tab when said circular lock is engaged by the locking tab.

20. The locking system of claim 19 wherein the rods are mounted to corresponding sleeves extending through the housing, the corresponding sleeves being mounted to corresponding shafts, the corresponding shafts being mounted to the three corners by corresponding bushings.

21. The locking system of claim 20 wherein the sleeves, the rods and the shafts are comprised of square tubing and solid bar joined by welding.

22. The locking system of claim 20 further comprising rod guides mounted proximate to the periphery of the door, the rod guides adapted to align the rods.

23. The locking system of claim 22 further comprising three lock rod guides mounted beyond the periphery of a door, each of the rods engaging one of the three lock rod guides when in the locked position.

24. The locking system of claim 19 wherein each rod is biased to the unlocked position.

* * * * *